US006750441B2

(12) United States Patent
Imahori et al.

(10) Patent No.: US 6,750,441 B2
(45) Date of Patent: Jun. 15, 2004

(54) SENSOR FOR AUTOMATIC DOORS

(75) Inventors: Naoki Imahori, Ohtsu (JP); Yasuhiro Takada, Ohtsu (JP)

(73) Assignee: Optex Co., Ltd., Shiga-ken (JP)

( * ) Notice: Subject to any disclaimer, the term of this patent is extended or adjusted under 35 U.S.C. 154(b) by 0 days.

(21) Appl. No.: 10/054,881

(22) Filed: Jan. 25, 2002

(65) Prior Publication Data

US 2002/0101348 A1 Aug. 1, 2002

(30) Foreign Application Priority Data

Jan. 26, 2001 (JP) ..... 2001-018780

(51) Int. Cl.[7] ..... H01J 40/14
(52) U.S. Cl. ..... 250/221; 340/545.3
(58) Field of Search ..... 250/221, 222.1, 250/214.5; 49/26–28, 25; 340/514, 516, 545.3, 600, 644

(56) References Cited

U.S. PATENT DOCUMENTS 4,520,262 A * 5/1985 Denton ..... 250/221
5,880,954 A * 3/1999 Thomson et al. ..... 700/79

FOREIGN PATENT DOCUMENTS

JP 2000-320243 11/2000

* cited by examiner

*Primary Examiner*—Thanh X. Luu
*Assistant Examiner*—Stephen Yam
(74) *Attorney, Agent, or Firm*—Wenderoth, Lind & Ponack, LLP

(57) ABSTRACT

In an auxiliary safety sensor 6 which has a first sensor set composed of a first transmitter 61 and a first receiver 63 located opposite to each other and a second sensor set composed of a second transmitter 62 and a second receiver 64 located opposite to each other, a test operation is performed by emitting a light beam only from the first transmitter 61. The state of misconnection is confirmed when a connection point 73 for the first receiver 61 does not receive predetermined light acceptance data for the amount of received light. To solve the misconnection, the light acceptance data based on the signals from the receivers 63, 64 are exchanged between each other, before they are supplied to the data acquisition means 8.

2 Claims, 5 Drawing Sheets

SENSOR FOR AUTOMATIC DOORS

BACKGROUND OF THE INVENTION

The present invention relates to a sensor for automatic doors. Particularly, the present invention concerns measures to simplify sensor installation.

With respect to an automatic door which opens and closes along a track, an object detection range is usually set on the interior and the exterior of the doorway, and objects in the detection range are detected by an activation sensor. As the activation sensor, there are generally known varieties like sensor mats, ultrasonic sensors and pyroelectric sensors. The activation sensor is turned on when it detects entry of an object within the detection range, and operates to open the door.

Additionally, an auxiliary safety sensor which utilizes a beam (e.g. infrared ray) is installed in the vicinity of the track of the door, between the interior and exterior detection ranges. An example of the auxiliary safety sensor is disclosed in Japanese Patent Laid-open Publication No. 2000-320243. This auxiliary safety sensor is mounted on a pair of posts which stand on both sides of the doorway, in such a manner that a transmitter on one of the posts is positioned face to face with a receiver on the other post. In this structure, when a light beam is emitted from the transmitter towards the receiver and interrupted by something, the receiver fails to receive the light beam. The sensor regards this condition as the presence of an object near the door track. Based on this recognition, the auxiliary safety sensor holds the door open even if the activation sensor is turned off. The auxiliary safety sensor is effective, for example, when a person stops on the door track. In this situation, the activation sensor is turned off, because this person's body is out of the interior and exterior detection ranges. Nevertheless, the auxiliary safety sensor can detect the person and keep the door open, thereby avoiding unexpected closure of the door.

As for installation of this type of auxiliary safety sensor, the transmitter and the receiver are equipped on the respective posts and have their signal lines passed inside the posts. Terminals at the ends of these signal lines are connected to a terminal block in an automatic door controller which is accommodated in a transom.

In order to enhance the reliability of object detection, this type of the auxiliary safety sensor may utilize two sensor sets, each of which is composed of a transmitter and a receiver. In a typical embodiment, the first sensor set (the first transmitter and the first receiver) and the second sensor set (the second transmitter and the second receiver) are provided at different heights. For this auxiliary safety sensor equipped with two sensor sets, the transmitters have their light emission timings (timings of generating light emission pulses) delayed from one another, in an attempt to ensure reliable light emission/acceptance actions at each sensor set (i.e. intended to prevent either receiver from operating in response to the light emitted from the other sensor set). In other words, the auxiliary sensor determines the absence of an object only when each receiver receives light in synchronization with the light emission timing of the opposite transmitter.

Regarding the installation of the auxiliary safety sensor with two sensor sets, two transmitters are equipped on one post and two receivers are mounted on the other post. Signal lines extending from these transmitters and receivers are passed inside the posts, so that each post contains two signal lines. Terminals (four terminals in total) at the ends of the signal lines are connected to a terminal block in an automatic door controller which is housed in a transom.

However, it is confusing to establish connection between the terminal block and the two signal lines passed inside each post. Namely, a worker may not be sure of the correlations between the transmitters and the signal lines in the first post (i.e. to find out which signal line comes from which transmitter), and the correlations between the receivers and the signal lines in the second post (i.e. to find out which signal line comes from which receiver). Thus, the sensor installation operation may end in misconnection, in which state the terminals are not connected to predetermined connection points at the terminal block in the automatic door controller. An example of misconnection is shown by the broken lines in FIG. 3 (the view showing how the transmitters 61, 62 and the receivers 63, 64 are connected to the terminal block 7). In this example, the signal line 63*a* coming from the first receiver 63 is connected to the connection point 74 for the second receiver 64, while the signal line 64*a* extending from the second receiver 64 is connected to the connection point 73 for the first receiver 63. In terms of signal processing, the first transmitter 61 and the second receiver 64 constitute a sensor set, and the second transmitter 62 and the first receiver 63 are paired as another sensor set, in a wrong manner. The transmitters and the receivers in these sensor sets are not opposed to each other. As a result, when the first receiver 63 receives a light beam produced at a given emission timing by the first transmitter 61, light acceptance data acquired by the first receiver 63 are inputted into the connection point 74 for the second receiver 64. Because this input does not coincide with a given acceptance timing, the sensor judges that no light is received. Similarly, when the second receiver 64 receives a light beam produced at a given emission timing by the second transmitter 62, light acceptance data acquired by the second receiver 64 are inputted into the connection point 73 for the first receiver 63. Because this input does not coincide with a given acceptance timing, the sensor judges that no light is received. While both sensor sets determine that the emitted light beams are interrupted by an object, the auxiliary safety sensor prohibits the closing action of the door, constantly leaving the door open. Unfortunately, it is impossible to notice the misconnection before an actual test operation of the automatic door. If misconnection is found by the operation test, a worker has to reconnect the signal lines, which complicates the sensor installation.

Various ideas have been suggested to prevent the misconnection. For one, signal lines of different colors can be employed. For another, tags can be attached to the signal lines in order to distinguish the sensor sets. In the former method, however, a worker has to bear a heavier burden of remembering the colors of the signal lines when he or she mounts the transmitters and the receivers on the posts. Besides, the latter method is detrimental to the operability, because the tags hinder the passage of the signal lines through the posts.

SUMMARY OF THE INVENTION

The invention is made in view of these problems and concerns a sensor for automatic doors which detects the presence of an object in an object detection area, with utilizing a plurality of sensor sets each being composed of a transmitter and a receiver. An object of the present invention is to correct misconnection of the transmitter and the receiver automatically, thereby ensuring the reliability of the detection performance of the sensor.

According to the present invention, the first solution for achieving the above object is based on a sensor for automatic doors having a plurality of sensor sets, each of the sensor sets being composed of transmission means and receiving means located opposite to each other across an object detection area, so that the sensor determines the presence or absence of an object within the object detection area, depending on whether a light beam emitted from each transmission means is received by the receiving means of the same sensor set. According to the first solution, this sensor is provided with data acquisition means and data exchange means. The data acquisition means is used to acquire light acceptance data sent from each receiving means. The data exchange means serves to exchange light acceptance data sent from one of the receiving means with those sent from any of the other receiving means, in order that the data acquisition means can acquire predetermined light acceptance data which concern a light beam emitted from one of the transmission means and which are received by the opposite receiving means. The data exchange action is carried out in the case where the data acquisition means fails to acquire the predetermined light acceptance data, provided that the transmission means emits a light beam in the absence of an object within the object detection area.

With this feature, if the data acquisition means fails to receive the predetermined light acceptance data while one of the transmission means emits a light beam, the sensor judges that the connection is improper. The misconnection can be automatically corrected by exchanging the light acceptance data with each other. Hence, a worker can engage in the connection operation without paying particular attention to the correlations between the transmitters and the signal lines or between the receivers and the signal lines. The sensor installation can be simplified in this way.

The second solution specifies the sensor structure. Based on the first solution, the second solution employs two such sensor sets. The data exchange means exchanges light acceptance data sent from one of the two receiving means with those sent from the other receiving means. This data exchange action is carried out in the case where the data acquisition means fails to acquire the predetermined light acceptance data, provided that either of the two transmission means emits a light beam in the absence of an object within the object detection area.

The third solution specifies the data exchange action. Based on the first solution, the third solution allows each of the transmission means to emit a light beam one by one. The data exchange means exchanges light transmission data sent from receiving means which receives the greatest amount of light, with those sent from receiving means located opposite to the transmission means which emits a light beam, in order that the data acquisition means can acquire the former data as the latter data. This data exchange action is carried out in the case where the data acquisition means fails to acquire the predetermined light transmission data, provided that each transmission means emits a light beam, by turns, in the absence of an object within the object detection area.

These features embody how to exchange the light acceptance data. Owing to the third solution, the data exchange action can be performed properly even if the sensor for automatic doors has more than two sensor sets. In this case, the transmission means can be related with the opposite receiving means by specifying the receiving means that receives the greatest amount of light.

DESCRIPTION OF THE PREFERRED EMBODIMENTS

An embodiment of the present invention is hereinafter described with reference to the drawings. In the embodiment, the sensor for automatic doors of the present invention is applied as an auxiliary safety sensor.

Figure 1:
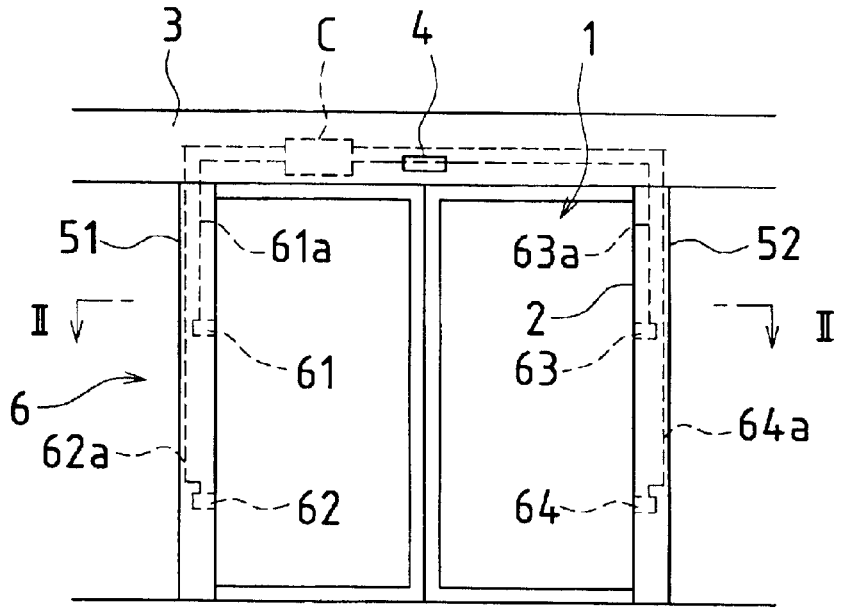
FIG. 1 is a front view of an automatic door in an embodiment.
Figure 2:
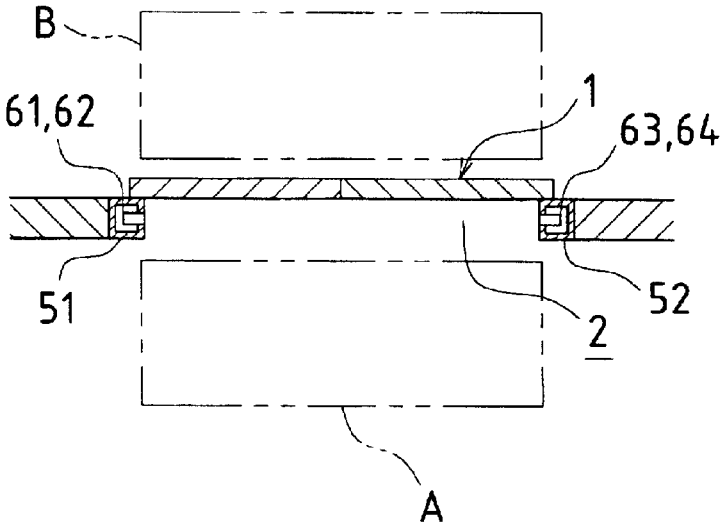
FIG. 2 is a sectional view taken along the line II—II in FIG. 1.

As illustrated in FIG. 1 (front view of an automatic door) and FIG. 2 (sectional view taken along the line II—II in FIG. 1), an automatic door 1 used in this embodiment is a bi-parting door which opens and closes by sliding movement along a track (sideward movement in the drawings). Detection ranges A, B for detecting the presence of a person or other object are set on the interior and the exterior of a doorway 2, as defined by the imaginary lines in FIG. 2. A transom 3 over the doorway 2 is equipped with a pair of activation sensors 4 for detecting the presence/absence of an object within the detection ranges A, B (FIG. 1 shows only one activation sensor). The activation sensor 4 is a common ultrasonic or pyroelectric sensor. On detecting the entry of an object into the detection area A or B, the sensor 4 is turned on and transmits an object detection signal to an automatic door controller C housed in the transom 3. In response to the detection signal, a driving motor in the door opening/closing mechanism (not shown) is driven to open the door. Since the door opening/closing mechanism is well known, its description is omitted herein.

Figure 3:
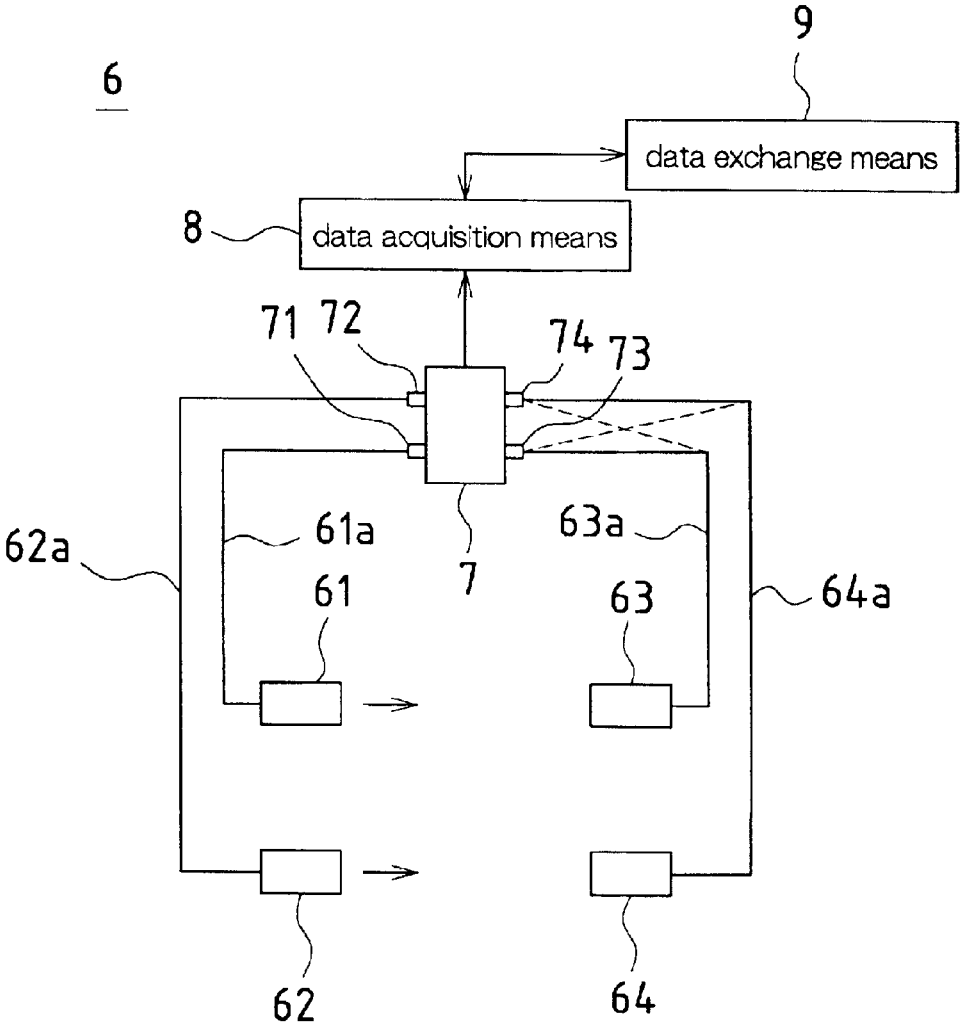
FIG. 3 shows how the transmitters and the receivers are connected to the terminal block.

An auxiliary safety sensor 6 is installed in a pair of posts 51, 52 which stand on both sides of the doorway 2. The auxiliary safety sensor 6 is constituted with first and second transmitters 61, 62 (transmission means) provided in the first post 51, and first and second receivers 63, 64 (receiving means) provided in the second post 52. The transmitters 61, 62 are positioned face to face with the receivers 63, 64, respectively. Signal lines 61*a*, 62*a*, 63*a*, 64*a* drawn from these transmitters and receivers are passed inside the posts 51, 52. Terminals attached to the ends of the signal lines are connected to a terminal block 7 on a control board of the automatic door controller C (see FIG. 3). Where a proper connection is established, as indicated in solid lines in FIG. 3, the signal line 61*a* extending from the first transmitter 61 is connected to a connection point 71 for the first transmitter 61, the signal line 62*a* extending from the second transmitter 62 is connected to a connection point 72 for the second transmitter 62, the signal line 63*a* extending from the first receiver 63 is connected to a connection point 73 for the first receiver 63, and the signal line 64*a* extending from the second receiver 64 is connected to a connection point 74 for the second receiver 64. With a proper connection, a first sensor set is constituted with the first transmitter 61 and the opposing first receiver 63, while a second sensor set is made up of the second transmitter 62 and the opposing second receiver 64. If at least one of light beams emitted by the transmitters 61, 62 toward the receivers 63, 64 is interrupted and not received by the receivers 63, 64, then the sensor 6 recognizes the presence of an object near the track of the door. Based on this recognition, the auxiliary safety sensor 6 holds the door open even if the activation sensor is turned off.

Further, in order to ensure the reliability of the light emission/acceptance actions at each sensor set, the transmitters 61, 62 of this auxiliary safety sensor 6 have different emission timings (timings of generating light emission pulses, and frequencies) from each other. Accordingly, the receivers 63, 64 determine the absence of an object within the object detection areas near the track, only when they receive a light beam in synchronization with the emission timings of the corresponding transmitters 61, 62. To be specific, the transmitters 61, 62 emit a light beam alternately at given time intervals. During their light emission action, the auxiliary sensor unit 6 confirms the absence of an object, only if the following condition is satisfied. Namely, when data acquisition means 8 in the automatic door controller C obtains light acceptance data from either of the receivers 63, 64, the light acceptance data must be fed to the connection point 73 for the first receiver 63 in synchronization with the emission timing of the first transmitter 61, or the light acceptance data must be fed to the connection point 74 for the second receiver 64 in synchronization with the emission timing of the second transmitter 62.

As a feature of this embodiment, the automatic door controller C is provided with data exchange means 9 which serves to exchange the light acceptance data between the receivers 63, 64 before the data are supplied to the data acquisition means 8. The data exchange action takes place in the case where the data acquisition means 8 fails to receive predetermined light acceptance data, with a proviso that one of the transmitters 61, 62 emits a light beam in the absence of an object near the door track. The data exchange action ensures that the light acceptance data acquired in connection with the light beams from the transmitters 61, 62 are the data respectively supplied from the receivers 63, 64 which locate face to face with the transmitters 61, 62. In the correct connection state, on the one hand, it is unnecessary to exchange the light acceptance data between the receivers 63, 64, because the light acceptance data from the first receiver 63 are transmitted to the connection point 73 for the first receiver 63, while the light acceptance data from the second receiver 64 are transmitted to the connection point 74 for the second receiver 64.

On the other hand, the data exchange means 9 is arranged to exchange the light acceptance data between the receivers 63, 64 in the state of misconnection (shown by the broken lines in FIG. 3), in which case the signal line 63*a* of the first receiver 63 is connected to the connection point 74 for the second receiver 64, and the signal line 64*a* of the second receiver 64 is connected to the connection point 73 for the first receiver 63. In terms of signal processing, the first transmitter 61 is paired with the second receiver 64, whereas the second transmitter 62 is paired with the first receiver 63. Eventually, when a light beam is produced at a given emission timing by the first transmitter 61 and received by the first receiver 63, the light acceptance data acquired by the first receiver 63 are inputted into the connection point 74 for the second receiver 64. Because this input does not coincide with the given emission timing for the second receiver 64, the auxiliary safety sensor 6 judges that no light is received. Likewise, when a light beam is produced at a given emission timing by the second transmitter 62 and received by the second receiver 64, the light acceptance data acquired by the second receiver 64 are inputted into the connection point 73 for the first receiver 63. Because this input does not coincide with the given emission timing for the first receiver 63, the sensor 6 judges that no light is received. While both sensor sets wrongly determine that the emitted light beams are interrupted by an object, the auxiliary safety sensor prohibits the closing action of the door. To solve this problem, the data exchange means 9 exchanges the light acceptance data between the receivers 63, 64 in the case of misconnection. In terms of signal processing, this data exchange action allows the light acceptance data acquired by the first receiver 63 to be treated as those inputted from the connection point 73 for the first receiver 63 and similarly allows the light acceptance data acquired by the second receiver 64 to be treated as those inputted from the connection point 74 for the second receiver 64. The misconnection is automatically corrected by this action.

Figure 4:
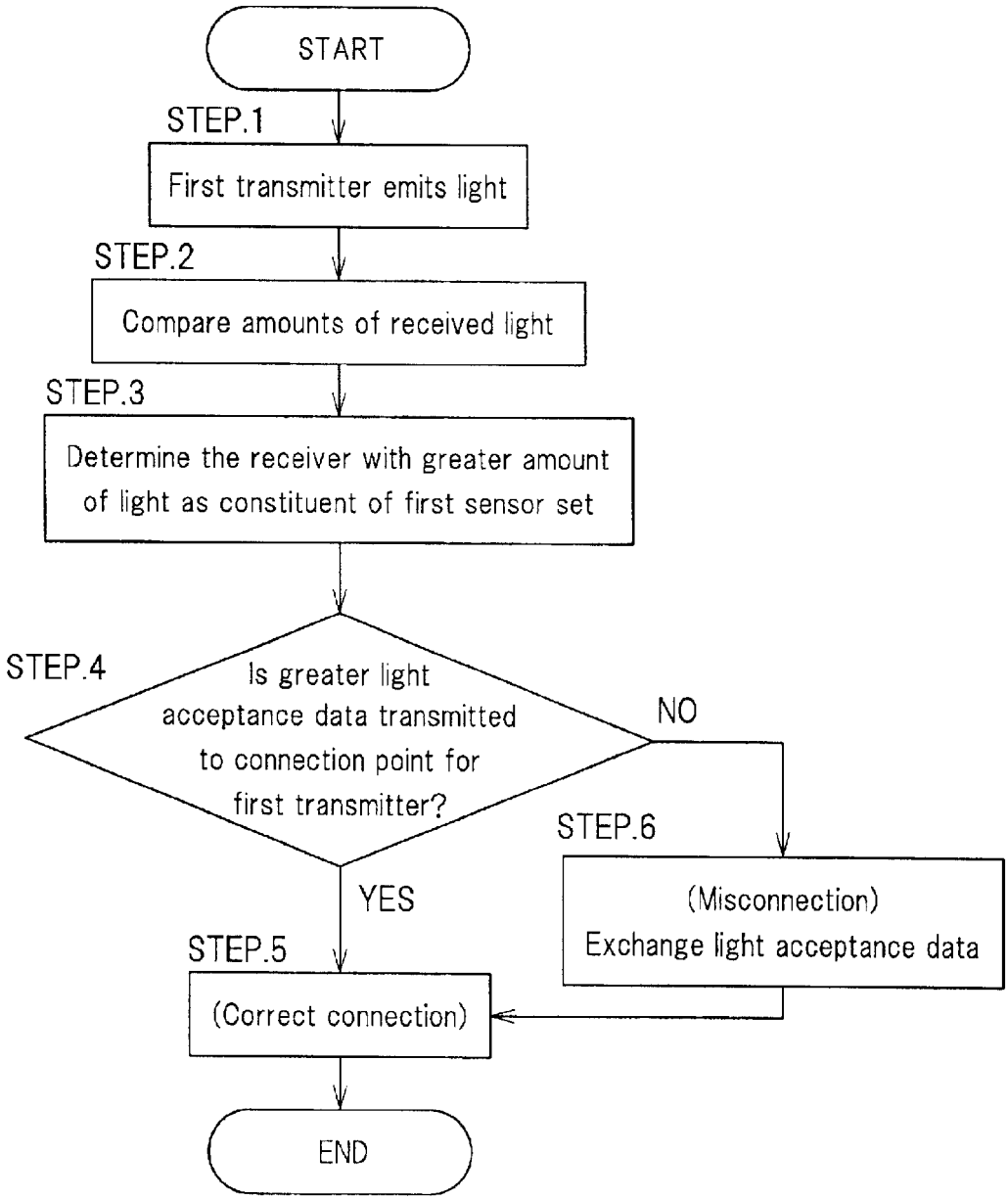
FIG. 4 is a flowchart which describes a test operation for an auxiliary safety sensor which has two sensor sets.

Misconnection in the auxiliary safety sensor 6 for automatic doors having two sensor sets is automatically corrected in a test operation during installation. The test operation of the auxiliary safety sensor 6 is described below, based on the flowchart in FIG. 4.

For the purpose of this test, it is assumed to be unclear whether the signal lines 61*a*–64*a* of the transmitters 61, 62 and the receivers 63, 64 are connected correctly. To start the test operation of the auxiliary safety sensor 6, a light beam is emitted only from the first transmitter 61 (STEP 1). Then, data for the amounts of light received by the receivers 63, 64 are transmitted to the automatic door controller C, in which the transmitted signals are converted from analog to digital to compare the amounts of received light (STEP 2). Based on the result of comparison, the receiver which has received a greater amount of light is regarded as the receiver which should be paired with the first transmitter 61 to constitute the first sensor set (STEP 3) With respect to the light acceptance data sent from the receiver which has received a greater amount of light, it is judged whether the data are transmitted to the connection point 73 for the first receiver 63 (STEP 4). If the connection point 73 for the first receiver 63 actually receives the light acceptance data sent from the receiver which has received a greater amount of light, the connection state is recognized as correct (STEP 5). In this case, the data exchange means 9 does not exchange the light acceptance data between the receivers 63, 64. On the other hand, if the light acceptance data are not directed to the connection point 73 for the first receiver 63 (i.e. if the data from the receiver which has received a greater amount of light are transmitted to the connection point 74 for the second receiver 64), the connection state is regarded as improper. On recognition of misconnection, the data exchange means 9 exchanges the light acceptance data between the receivers 63, 64 (STEP 6). Despite the misconnection, this data exchange action allows the first transmitter 61 to be paired with the first receiver 63, and the second transmitter 62 to be paired with the second receiver 64, in terms of signal processing.

In the above manner, the present embodiment can automatically correct misconnection. As a consequence, when a worker intends to establish connections between the terminal block 7 and the signal lines 61*a*–64*a* drawn from the transmitters 61, 62 and the receivers 63, 64, he or she can engage in the connection operation without paying particular attention to the correlations between the transmitters 61, 62 and the signal lines 61*a*, 62*a* (i.e. to find out which signal line comes from which transmitter) or the correlations between the receivers 63, 64 and the signal lines 63*a*, 64*a* (i.e. to find out which signal line comes from which receiver). Eventually, the present embodiment can sufficiently ensure the reliability of the object detection performance of the auxiliary safety sensor 6, with simplifying the sensor installation.

In the above test operation for the auxiliary safety sensor 6, the state of misconnection is judged by emitting a light beam only from the first transmitter 61. In addition to this, a light beam may be emitted only from the second transmitter 62 to see if misconnection has occurred or not. The double test operation makes the result of the misconnection judgement more reliable.

The auxiliary safety sensor 6 used in the above embodiment is composed of two sensor sets. From another aspect, the present invention is also applicable to an auxiliary safety sensor 6 which has three or more sensor sets. The test operation of the latter sensor is explained by the flowchart in FIG. 5.

The following description is based on the assumption that the auxiliary safety sensor is composed of n sensor sets (n is 3 or greater). k indicates a serial number assigned to each transmitter (k. is an integer not less than 0). The initial value of k is set to zero (STEP 1). The value of k is changed to "1" by adding one to the initial value, so that the first transmitter is designated as the transmitter to emit a light beam (STEP 2). At this stage, the sensor compares the values of k and n (STEP 3). If k is less than n, the first transmitter is allowed to emit a light beam (STEP 4). If k is not less than n, the process ends without allowing any transmitter to emit a light beam. In the case where k is not less than n, (n−1) transmitters have performed light emission actions for the test, and, accordingly, the last n-th transmitter is paired with a proper receiver to constitute the sensor set.

Based on the result of STEP 4, in which a light beam is emitted from the first transmitter, the sensor determines which of the n receivers has received the greatest amount of light, and regards it as a constituent of the first sensor set (STEP 5). The next step is to see whether the light acceptance data of the greatest value are transmitted to the connection point for the first receiver (STEP 6). If the greatest light acceptance data are sent to the connection point for the first receiver, the sensor confirms that the connection is properly established (STEP 7), and the procedure returns to STEP 2. However, if the greatest light acceptance data are not sent to the connection point for the first receiver, the sensor assumes the connection to be wrong, and exchanges the misdirected data with the data from the first receiver (STEP 8). After the data exchange, the procedure returns to STEP 2.

In the cases of k=2, 3 . . . (n−1), a series of above steps are sequentially repeated in the same manner to determine the correct transmitter/receiver combination for each sensor set. Thus, if the auxiliary safety sensor has more than two sensor units, misconnection can be automatically corrected by exchanging their light acceptance data in a suitable manner, just as the case of the auxiliary safety sensor with two sensor sets. As a result, it is still possible to simplify the sensor installation and to ensure the reliability of the object detection performance of the auxiliary safety sensor.

Figure 5:
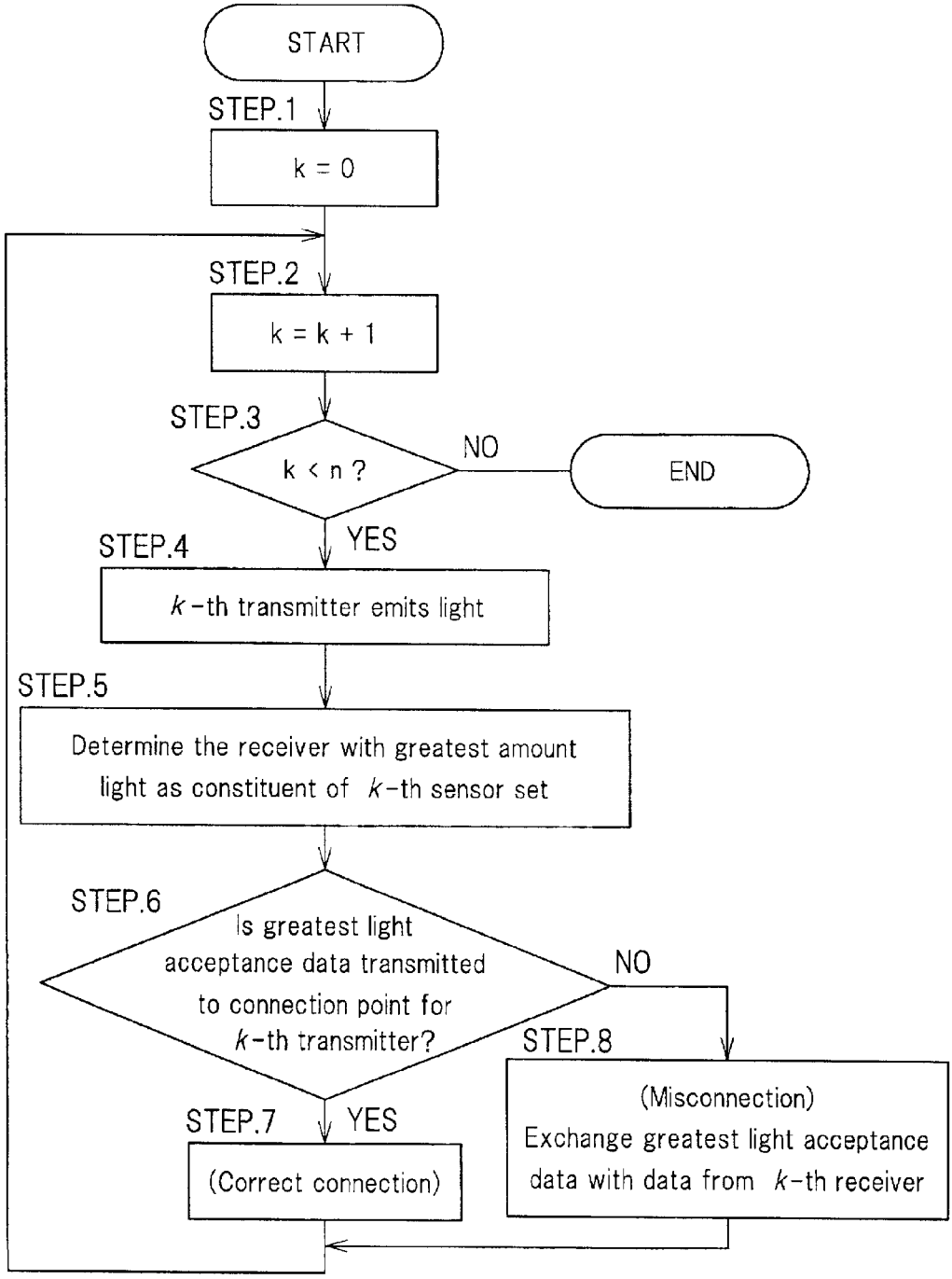
FIG. 5 is a flowchart which describes a test operation for an auxiliary safety sensor which has three or more sensor sets.

It should be understood that the flowchart in FIG. 5 is applicable to the sensor using a plurality of sensor sets (i.e. two sensor sets as well as three or more sensor sets).

It should be further understood that the present invention is not only applicable to a bi-parting automatic door as described in the above embodiment, but also applicable to single sliding automatic doors.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

The present application is based on Japanese Patent Application No. 2001-18710, the content of which is incorporated herein by reference. In addition, the document cited in this specification is incorporated herein by reference in its entirety.

What is claimed is:

1. A sensor for use with automatic doors and operable to determine the presence or absence of an object within an object detection area, said sensor comprising:

a plurality of sensor sets, each of said sensor sets comprising a transmission means for transmitting light and a receiving means for receiving light located to oppose each other across the object detection area so that said sensor is operable to determine the presence or absence of an object within the object detection area depending on whether light emitted from each transmission means is received by an opposing receiving means;

data acquisition means for acquiring light acceptance data sent from a first receiving means of said plurality of receiving means of said plurality of sensor sets and light acceptance data sent from a second receiving means of said plurality of receiving means of said plurality of sensor sets; and data exchange means for exchanging the light acceptance data from said first receiving means with the light acceptance data from said second receiving means, such that said data acquisition means is operable to acquire predetermined light acceptance data based on light emitted from one of said transmission means and that is received by an opposing receiving means, wherein said data exchange means is operable to exchange light acceptance data when said data acquisition means fails to acquire the predetermined light acceptance data, provided that one of said transmission means emits light in the absence of an object within the object detection area, wherein said transmission means are operable, one by one, to emit light, wherein said data exchange means is further operable to exchange light acceptance data sent from a receiving means that receives the greatest amount of light with light acceptance data sent from a receiving means located to oppose a transmission means that emits light, and wherein said data exchange means is still further operable to exchange light acceptance data when said data acquisition means fails to acquire the predetermined light acceptance data, provided that one of said transmission means emits light in the absence of an object within the object detection area.

2. A sensor for use with automatic doors and operable to determine the presence or absence of an object within an object detection area, said sensor comprising:

a plurality of sensor sets, each of said sensor sets comprising a transmitter operable to transmit light and a receiver operable to receive light located to oppose each other across the object detection area so that said sensor is operable to determine the presence or absence of an object within the object detection area depending on whether light emitted from a transmitter is received by an opposing receiver;

data acquisition means for acquiring light acceptance data sent from a first receiver of said plurality of receivers of said plurality of sensor sets and light acceptance data sent from a second receiver of said plurality of receivers of said plurality of sensor sets; and a data exchanger operable to exchange the light acceptance data from said first receiver with the light acceptance data from said second receiver, such that said data acquisition means is operable to acquire predetermined light acceptance data based on light emitted from one of said transmitters and that is received by an opposing receiver, wherein said data exchanger is operable to exchange light acceptance data when said data acquisition means fails to acquire the predetermined light acceptance data, provided that one of said transmitters emits light in the absence of an object within the object detection area, wherein said transmitters are further operable, one by one, to emit light, wherein said data exchanger is further operable to exchange light acceptance data sent from a receiver that receives the greatest amount of light, with light acceptance data sent from a receiver located to oppose a transmitter that emits light, and wherein said data exchanger is operable to exchange the light acceptance data when said data acquisition means fails to acquire the predetermined light acceptance data, provided that one of said transmitters emits light in the absence of an object within the object detection area.

* * * * *